US011751645B2

(12) United States Patent
Wolf

(10) Patent No.: US 11,751,645 B2
(45) Date of Patent: Sep. 12, 2023

(54) CUSTOMIZABLE WRIST BAND

(71) Applicant: Brandon Wolf, Destin, FL (US)

(72) Inventor: Brandon Wolf, Destin, FL (US)

( * ) Notice: Subject to any disclaimer, the term of this patent is extended or adjusted under 35 U.S.C. 154(b) by 91 days.

(21) Appl. No.: 17/508,196

(22) Filed: Oct. 22, 2021

(65) Prior Publication Data

US 2023/0127544 A1 Apr. 27, 2023

(51) Int. Cl.
*A44C 5/00* (2006.01)

(52) U.S. Cl.
CPC ..... *A44C 5/0053* (2013.01)

(58) Field of Classification Search
CPC ..... A44C 5/0053; A44C 5/025; A44C 25/007; A44C 13/00
See application file for complete search history.

(56) References Cited

U.S. PATENT DOCUMENTS

| | | | |
|---|---|---|---|
| 1,481,894 | A | 1/1924 | Fishel |
| 2,322,461 | A | 6/1943 | Mariano |
| 5,630,329 | A | 5/1997 | Lauffer et al. |
| 8,296,983 | B2 | 10/2012 | Padgett et al. |
| 10,893,725 | B1 | 1/2021 | Wolf |

FOREIGN PATENT DOCUMENTS

| | | | |
|---|---|---|---|
| CH | 222017 A | * | 6/1942 |
| FR | 1474672 A | * | 4/1966 |

* cited by examiner

*Primary Examiner* — Jack W Lavinder
(74) *Attorney, Agent, or Firm* — Harpman & Harpman

(57) ABSTRACT

An adaptable customizable wristband including a flexible segmented adjustable support band onto which different design charms and dividers are positioned. Support band segments can be selectively removed to vary the wristband's length with an end clasp for securing the assembled wristband together. The design elements allow the user to combine different image charms with the ability to change the number, position and variety of decorative elements on a wristband for custom personalized look.

7 Claims, 3 Drawing Sheets

CUSTOMIZABLE WRIST BAND

BACKGROUND OF THE INVENTION

1. Technical Field

This invention relates to the field of decorative wrist bands and bracelets and more specifically to customizable wrist bands with interchangeable design elements on a flexible adjustable support band base.

2. Description of Prior Art

Prior art wrist bands of rubber silicone have limited single use and are designed typically for specific independent purpose and therefore such bands are limited to user specific designs.

A variety of wrist bands and bracelets are available where different design elements, "charms", can be attached as well as some interchangeability of elements, see for example U.S. Pat. Nos. 1,481,894, 2,322,461, 5,630,329, 8,296,983 and applicant's own U.S. Pat. No. 10,893,725.

In U.S. Pat. No. 1,481,894 a jewelry article is seen having a bracelet band with decorative elements positioned thereon.

U.S. Pat. No. 2,322,461 is directed to costume jewelry with a band formed of interlinked decorative indicia elements for day and date.

U.S. Pat. No. 5,630,329 claims a wrist watch bracelet illustrating a plurality of interlinked pivoted elements to form a band for a watch.

U.S. Pat. No. 6,880,364 discloses a decorative wristband bracelet having a one-piece band with designer elements positioned and retained thereon.

U.S. Pat. No. 8,296,983 describes an identification bracelet with interchangeable segments having adjustable band with a body and user identification to store user's ID.

Applicant's own U.S. Pat. No. 10,893,725 discloses a customizable wristband in which interchangeable panels are locked together with connectors to form a wristband structure.

SUMMARY OF THE INVENTION

A customizable wristband having multiple decorative design display elements selectively positioned on an integral, flexible support band with corresponding space dividers there between. The design display elements are freely movable on the support band which can be foreshortened by detaching and removing independent segments to the desired length. An end band clasp secures the completed wristband in end-to-end relation for placement and removal on the user's wrist.

DETAILED DESCRIPTION OF THE INVENTION

Figure 1:
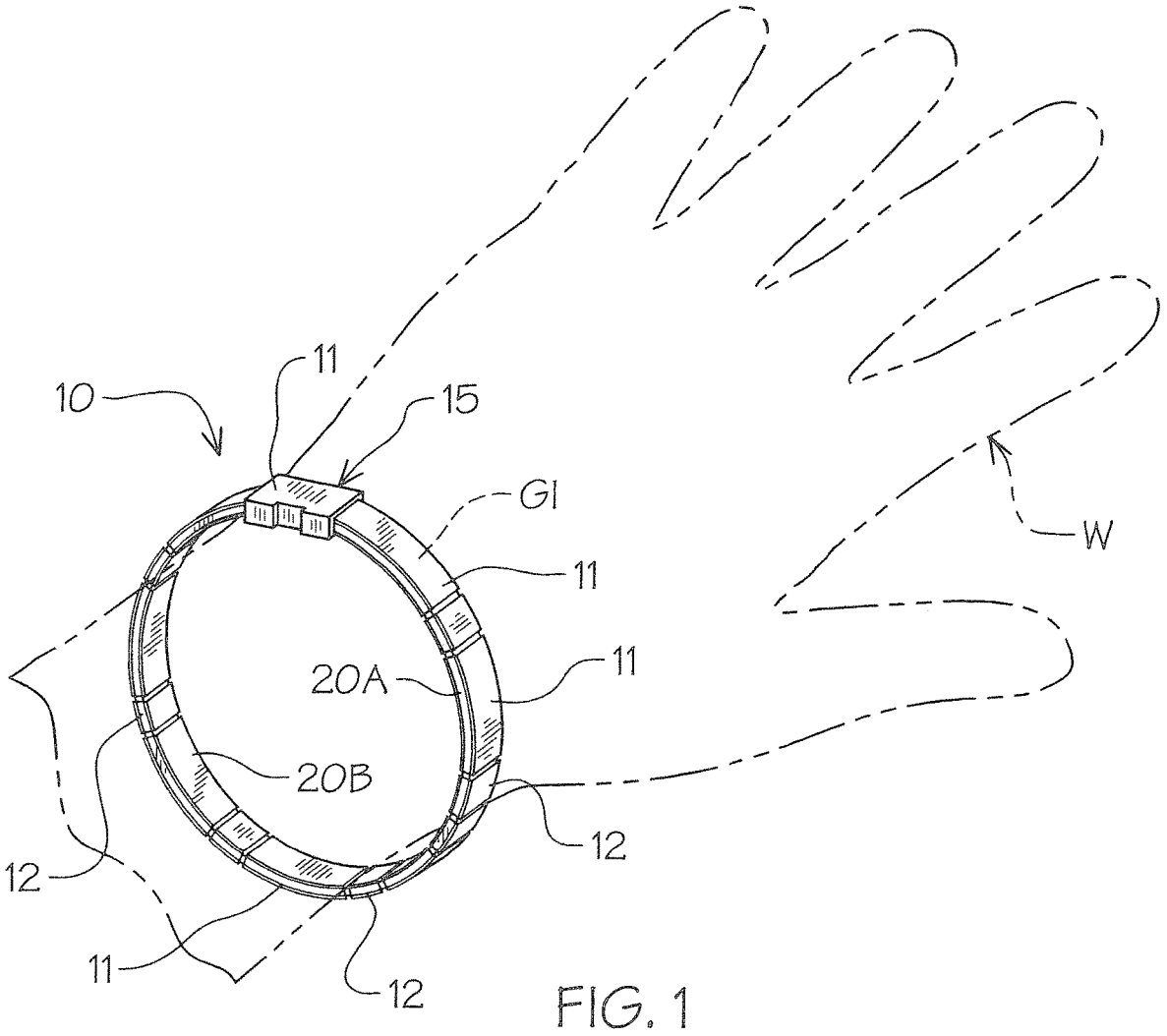
FIG. 1 is a perspective view of the assembled wristband positioned on the wrist of the user's representation shown in broken lines.
Figure 2:
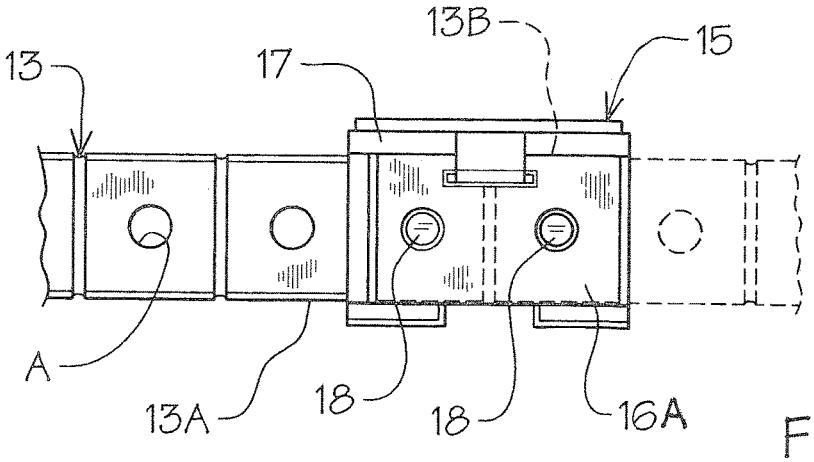
FIG. 2 is an enlarged top plan view of the clasp with fixed band extending therefrom and binds free end within in broken lines.
Figure 3:
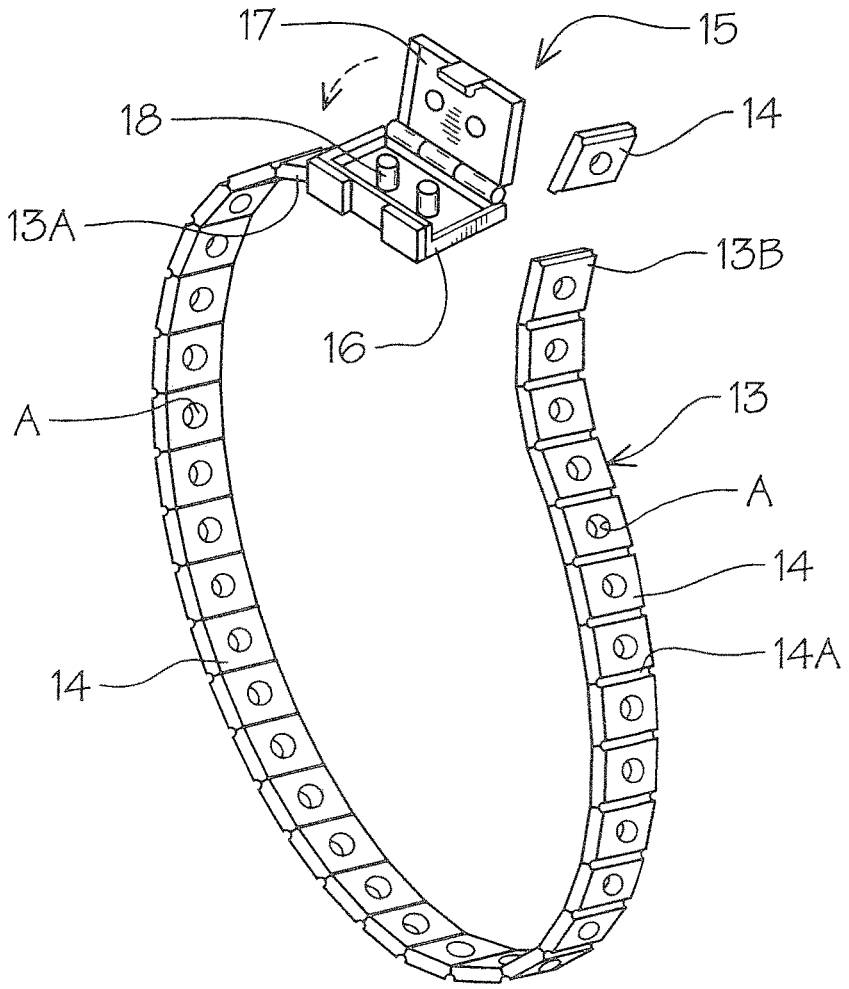
FIG. 3 is an enlarged perspective view of the wristband flexible support band with segment removed and end clasp fitting.
Figure 4:
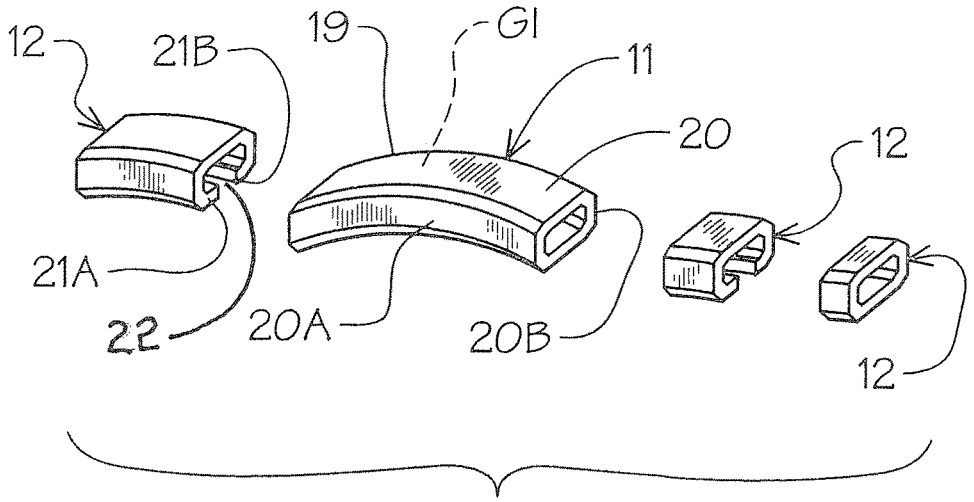
FIG. 4 is an enlarged perspective composite view of the selectively positioned decorative design elements and divider spacers.
Figure 5:
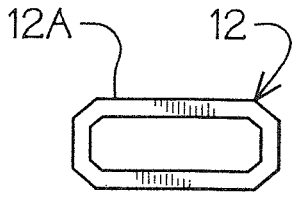
FIG. 5 is an enlarged end elevational view of a movable divider spacer.

Referring to FIGS. 1-3 of the drawings, a wristband 10 of the invention can be seen having a plurality of interchangeable decorative display design elements 11, charms, and intermediate dividers 12 positioned in end-to-end relation on a flexible underlying adjustable support band 13.

The flexible support band 13, best seen in FIG. 3 of the drawings, is divided into longitudinally spaced segments 14 defined by respective transverse areas of reduced band thickness at 14A allowing for individual segment 14 separation and removal illustrated graphically. Each of the so defined band segments 14 has an indexing aperture A centrally positioned therein. Selective segment 14 removal provides for custom foreshortening of the support band 13, as needed, to accommodate users in size delineation.

Figure 7:
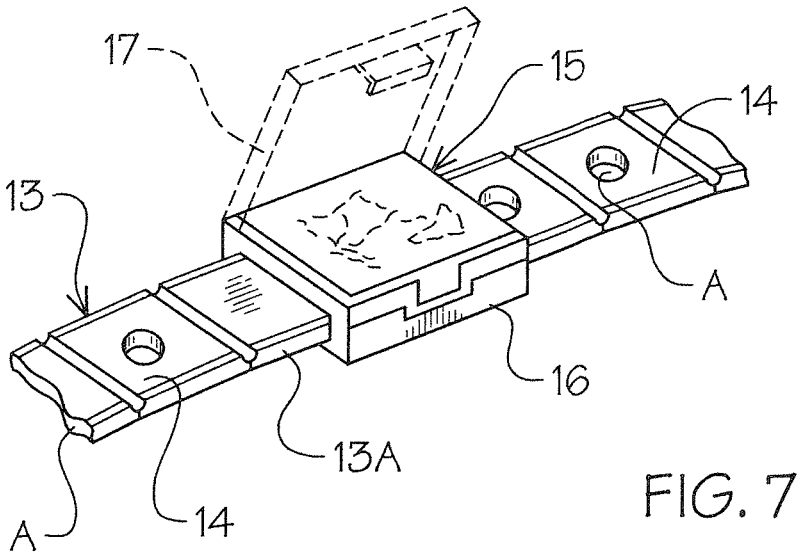
FIG. 7 is an enlarged perspective view of the flexible wrist support band and end clasp in closed position.
Figure 8:
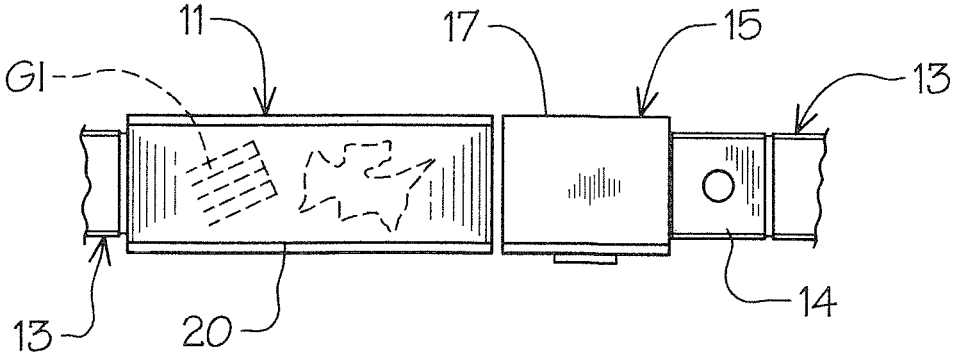
FIG. 8 is an enlarged partial top plan view of the wrist band with decorative element and end clasp in closed position.

A wristband end connector clasp 15 is illustrated having a base portion 16 with a hinge closure 17 and is secured to the free end 13A of the support band 13. A pair of spaced upstanding band engagement retainer pins 18 extend from the base interior at 16A for engagement within the so aligned support band indexing apertures A when inserted thereon and closes as seen in FIGS. 1, 7 and 8 of the drawings.

The decorative design elements 11 each have an elongated curvilinear body 19 with a continuous top display surface 20 with oppositely disposed spaced depending sidewalls 20A and 20B, each with respective elongated return flanges 21A and 21B forming a band receiving access opening at 22 which will be described in greater detail hereinafter.

Each of the decorative design elements 11 may be customized to contain a display varied graphic image GI illustrated in broken lines on their respective contoured top display surface 20 for visual display when assembled on a user's wrist W as seen in FIG. 1 of the drawings.

Each of the design element surface varied graphic images GI may be of embossed, printed or painted on its surface.

The decorative display elements 11, charm, may therefore be of different lengths and made of any suitable material such as molded synthetic resin-based material such as TPR or TPE. It will be evident that the dimension of the display design elements 11 may be varied while maintaining the support bands 13 engagement as described and initially moved freely thereon for user select positioning.

It is important to note that the dividers 12 are shown in multiple lengths and have two band engagement configurations illustrated at 12A and 12B. The dividers 12A are configured to be free moving, as noted, and be of any length to divide the display elements and fill in any spaces along the support band 13 not occupied by the design decorative elements 11.

Figure 6:
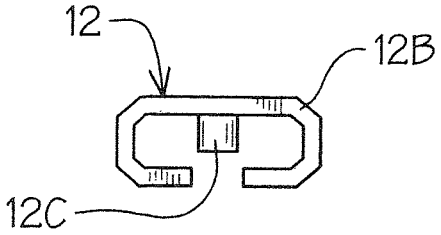
FIG. 6 is an enlarged end elevational view of the locking divider spacer.

The dividers 12B are defined as lock dividers having a small projection 12C, as best seen in FIG. 6 of the drawings that will engage the segment as 14 aperture A retaining dividers 12B positionally on the support band 13 preventing the display design elements 11 from moving freely on the band once positioned.

In use, the flexible support band 13's length is adjustable by selected segment 14 removal, if needed, and the individual wristband elements are positionally assembled thereon with the decorative elements 11, "charms", and selective dividers 12A and 12B acting as spacers arranged as described.

The connector clasp post 18 are engaged over the segments 14's aperture A's free end 13B and the hinge clasp snap shut thereon retaining same.

It will be evident from the above description that a selection of different design elements 11 about the support band 13 with movable and fixed dividers 12A and 12B therebetween will afford a variety of custom wristband configurations. The multiple positioned design elements 11 and selected dividers 12 are best seen in a completed wristband, on a user's wrist W, shown in broken lines, in FIG. 1 of the drawings thereby allowing the user to customize the wristband for both size and display characteristics important to them.

It will thus be seen that a new and novel customizable decorative wristband 10 of the invention has been illustrated and described and that various changes and modifications may be made thereto without departing from the spirit of the invention.

Therefore I claim:

1. A wristband assembly comprising, a flexible support band, a plurality of design elements slidably positioned on said support band, a closure clasp on one end of said flexible support band, said flexible support band is segmented for selective segment removal for shortening said flexible support band, said segments having an aperture therein, said closure clasp having a pair of spaced upstanding projections for registerably engaging apertured free end segments of said flexible support band, said closure clasp having a hinge closure registerably transversely over said projections securing said apertured free end segments within said closure clasp, a plurality of dividers are selectively positioned on said flexible support band.

2. The wristband assembly set forth in claim 1 wherein said plurality of design elements are curvilinear with graphics and indicia on said design elements respective surfaces.

3. The wristband assembly set forth in claim 2 wherein said graphics and indicia comprises, printed indicia, painted indicia, stickers, decals and embossed indicia.

4. The wristband assembly set forth in claim 1 wherein said dividers have band engagement and retainment elements thereon.

5. The wristband assembly set forth in claim 1 wherein said plurality of design elements are of rigid material.

6. The wristband assembly set forth in claim 1 wherein said plurality of design elements are of resilient flexible semi-flexible material.

7. The wristband assembly set forth in claim 1 wherein said plurality of design elements dividers have band engagement projections registerable on said support band.

* * * * *